US006239704B1

(12) United States Patent
Olson

(10) Patent No.: US 6,239,704 B1
(45) Date of Patent: May 29, 2001

(54) ALARM DEVICE FOR PHYSICALLY CHALLENGED INDIVIDUALS

(75) Inventor: Richard T. Olson, Cedar Rapids, IA (US)

(73) Assignee: Professional Security Corporation, Cedar Rapids, IA (US)

( * ) Notice: Subject to any disclaimer, the term of this patent is extended or adjusted under 35 U.S.C. 154(b) by 0 days.

(21) Appl. No.: 09/540,413

(22) Filed: Mar. 31, 2000

(51) Int. Cl.[7] ..... G08B 23/00

(52) U.S. Cl. ..... 340/573.1; 340/572.8; 340/575; 340/568.2; 340/687

(58) Field of Search ..... 340/573.1, 575, 340/573.3, 572.8, 686.1, 568.2, 687; 224/191

(56) References Cited

U.S. PATENT DOCUMENTS 3,887,909 * 6/1975 Beiswenger et al. ..... 340/274
4,858,622 * 8/1989 Osterweil ..... 128/782
5,653,336 * 8/1997 Buonaiuto et al. ..... 206/320
5,910,768 * 6/1999 Ott ..... 340/568.2
5,995,854 * 11/1999 Wilson ..... 455/575
6,049,286 * 4/2000 Forr ..... 340/687

* cited by examiner

*Primary Examiner*—Daniel J. Wu
*Assistant Examiner*—Son Tang
(74) *Attorney, Agent, or Firm*—James C. Nemmers

(57) ABSTRACT

The present invention relates to a simple alarm system that is activated when an actuator pin is pulled from a base. Unlike prior art personal alarm devices, the present invention does not require the user to activate the alarm manually. Therefore, the present invention may generate a signal for help when, for example, a patient has fallen and become unconscious or a patient at risk attempts to leave a safe, confined space.

5 Claims, 4 Drawing Sheets

FIG. 1
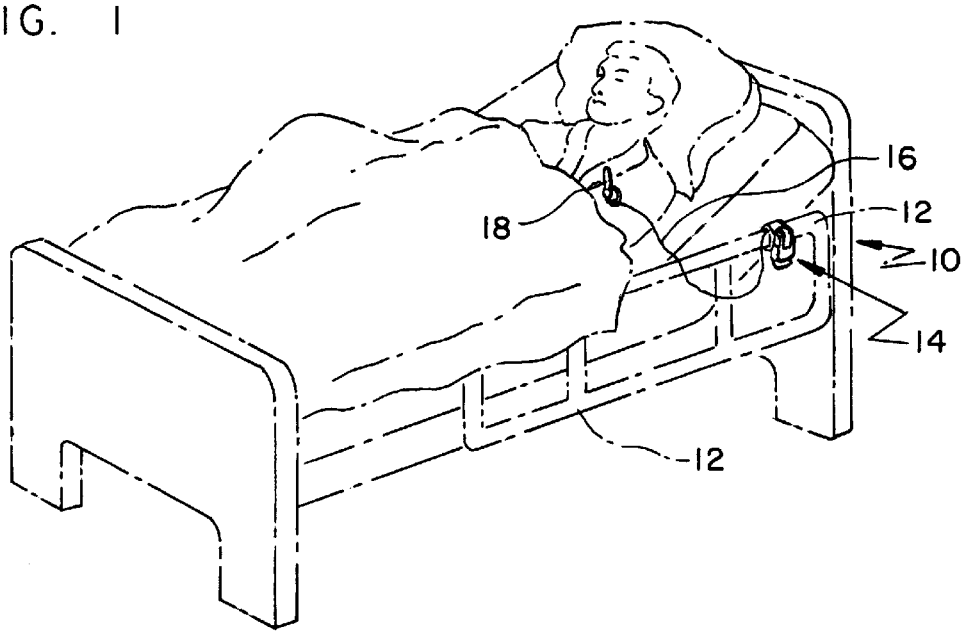
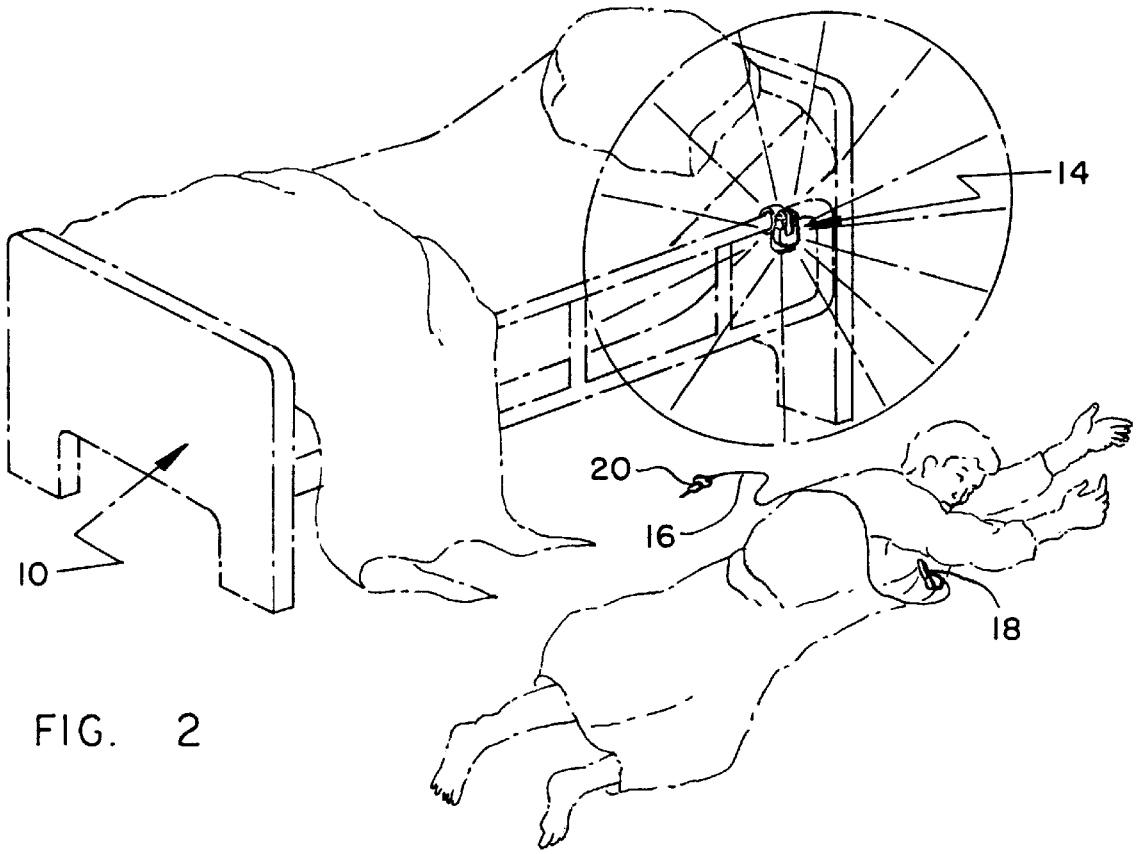
FIG. 2

ALARM DEVICE FOR PHYSICALLY CHALLENGED INDIVIDUALS

BACKGROUND OF THE INVENTION

Individuals who are physically challenged because of illness, disability or age, are frequently confined to a bed, wheelchair, or other situation in which their mobility is greatly limited. Such persons often require assistance in living, but typically, their activities cannot be monitored constantly around the clock. If such an individual attempts to leave a bed, chair, etc. or falls out of a wheelchair or bed, they may lie in an injured condition for a period of time that could endanger their health or even their life. Although the prior art shows numerous alarm devices or devices that can be actuated by the individual, if an individual is unconscious, or if the individual although conscious attempts to leave a chair or bed voluntarily when they should not do so, the person caring for the individual needs to be warned. The prior art does not disclose any satisfactory device that can be produced and marketed at a reasonable cost to provide protection for such individuals. There is therefore a need for a relatively simple and inexpensive device that can produce a warning when an individual moves from a situation either voluntarily or involuntarily resulting in possible injury to the individual.

SUMMARY OF THE INVENTION

The invention provides a device which consists of an alarm that is battery powered. The device has means for attaching the alarm component to a bed, wheelchair, etc. and attaching an alarm cord directly to the individual or the individual's clothing. When the individual moves beyond a predetermined range, the alarm cord will pull an actuator pin from the alarm causing the alarm to give off an audible warning.

BRIEF DESCRIPTION OF THE DRAWING

FIG. 1 is a perspective view illustrating an individual lying in a bed with the device of the invention attached to the individual and to the bed frame;

FIG. 2 is a perspective view showing the individual having fallen out of bed and illustrating the actuating cord being disconnected from the alarm device;

DESCRIPTION OF THE PREFERRED EMBODIMENT OF THE INVENTION

Figure 3:
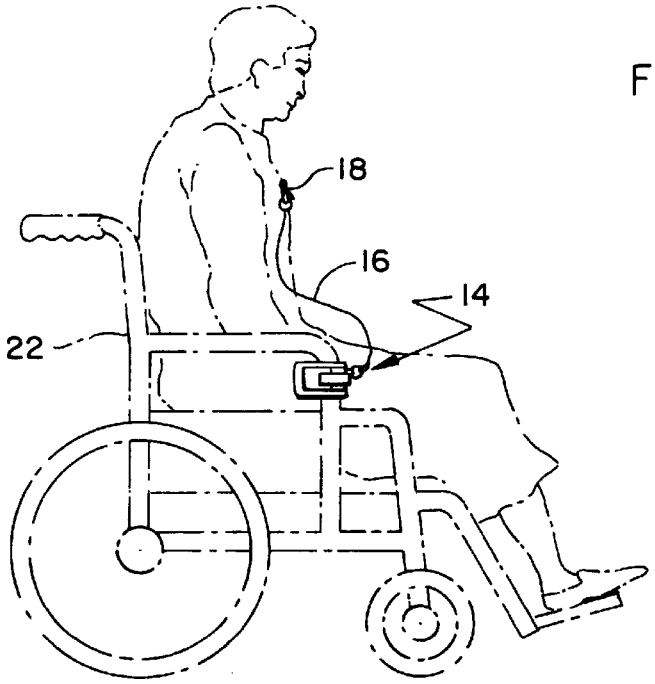
FIG. 3 is a side elevational view showing an individual resting in a wheelchair with the device affixed to the chair and with the actuator cord affixed to the individual.

In FIGS. 1 and 2 of the drawings, there is illustrated an individual patient confined to a bed 10 that has rails or frame members 12 as is well known. FIG. 1 shows the alarm or "base" component of the invention, illustrated generally by the reference numeral 14 affixed in the manner described hereinafter to a portion of the frame 12 of the bed 10. FIG. 1 also illustrates the actuator cord 16 hooked to the clothing of the individual with a suitable clip or other attachment means 18. FIG. 2 illustrates the individual having fallen out of bed so that the actuator cord 16 has pulled the alarm pin or "trigger" 20 from the alarm 14 and actuated the alarm.

Figure 4:
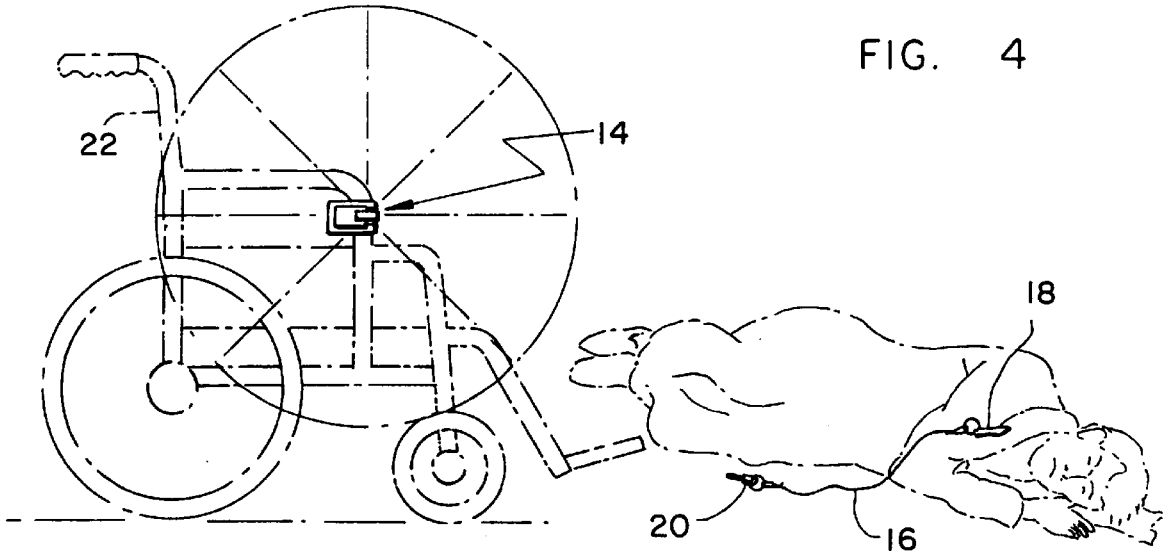
FIG. 4 is a device partly in section and partly in perspective showing the individual having fallen out of the wheelchair with the actuator cord disconnected from the alarm device.

FIGS. 3 and 4 are similar to FIGS. 1 and 2 except that they illustrate the alarm component 14 being attached to the frame of a wheelchair 22, with FIG. 4 illustrating what happens if the individual falls out of the wheelchair so that the actuator cord 16 causes the pin 20 to be pulled from the alarm component 14.

Figure 5:
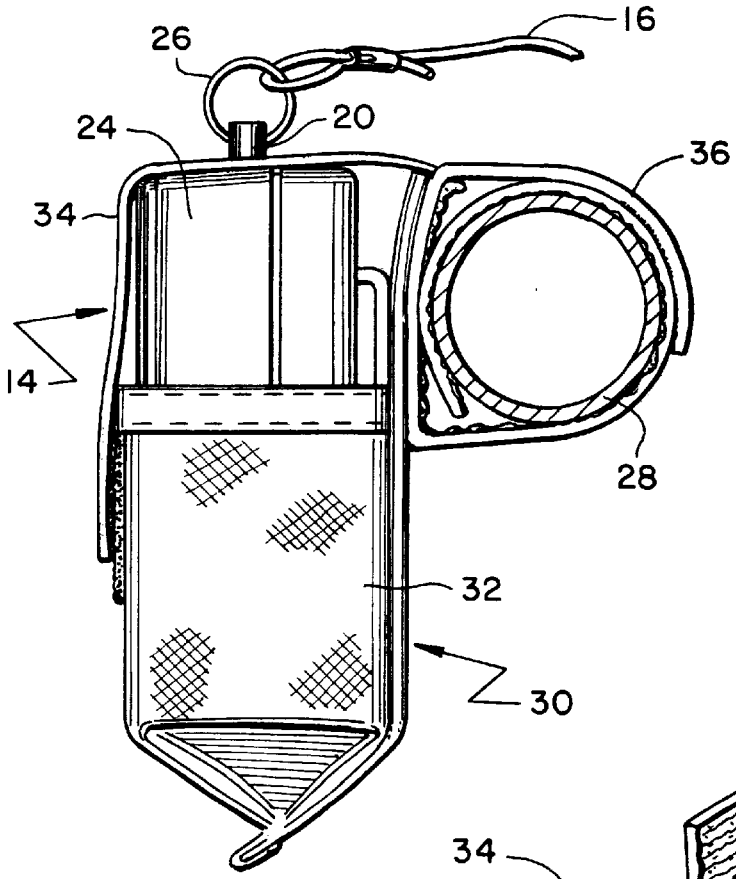
FIG. 5 is a side elevational view of the alarm component of the device showing it fastened to the rail of a bed or wheelchair.
Figure 6:
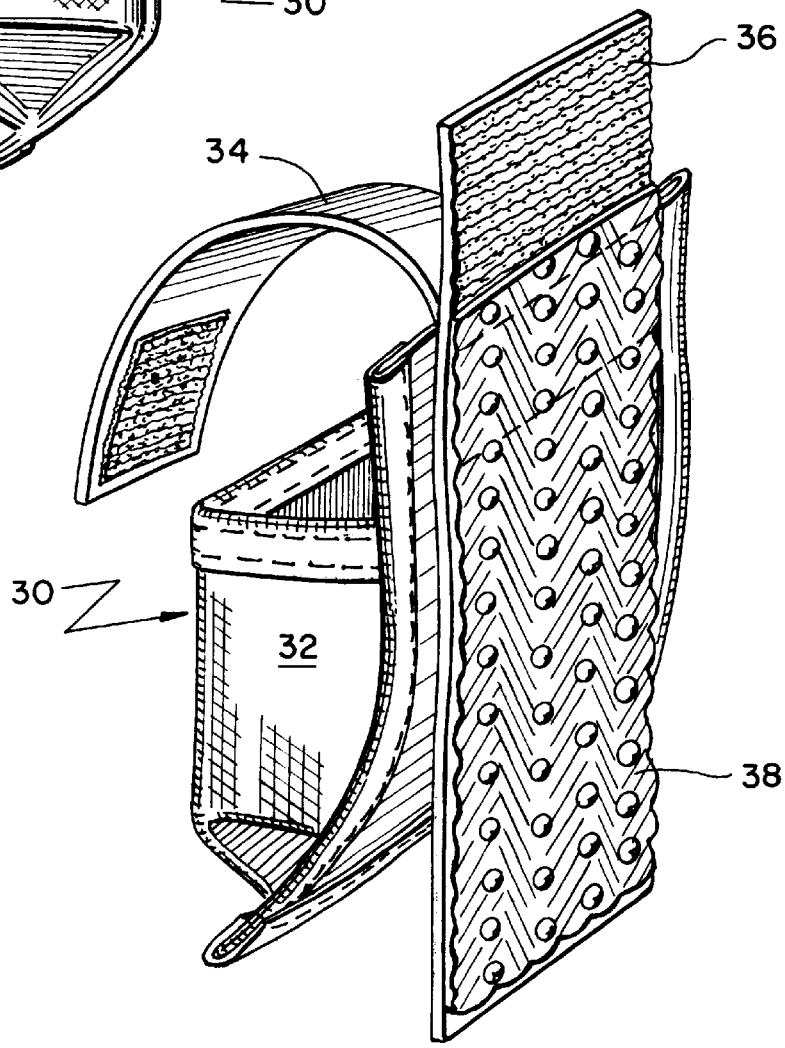
FIG. 6 is a perspective view showing another means of attaching the device using Velcro fasteners.
Figure 7:
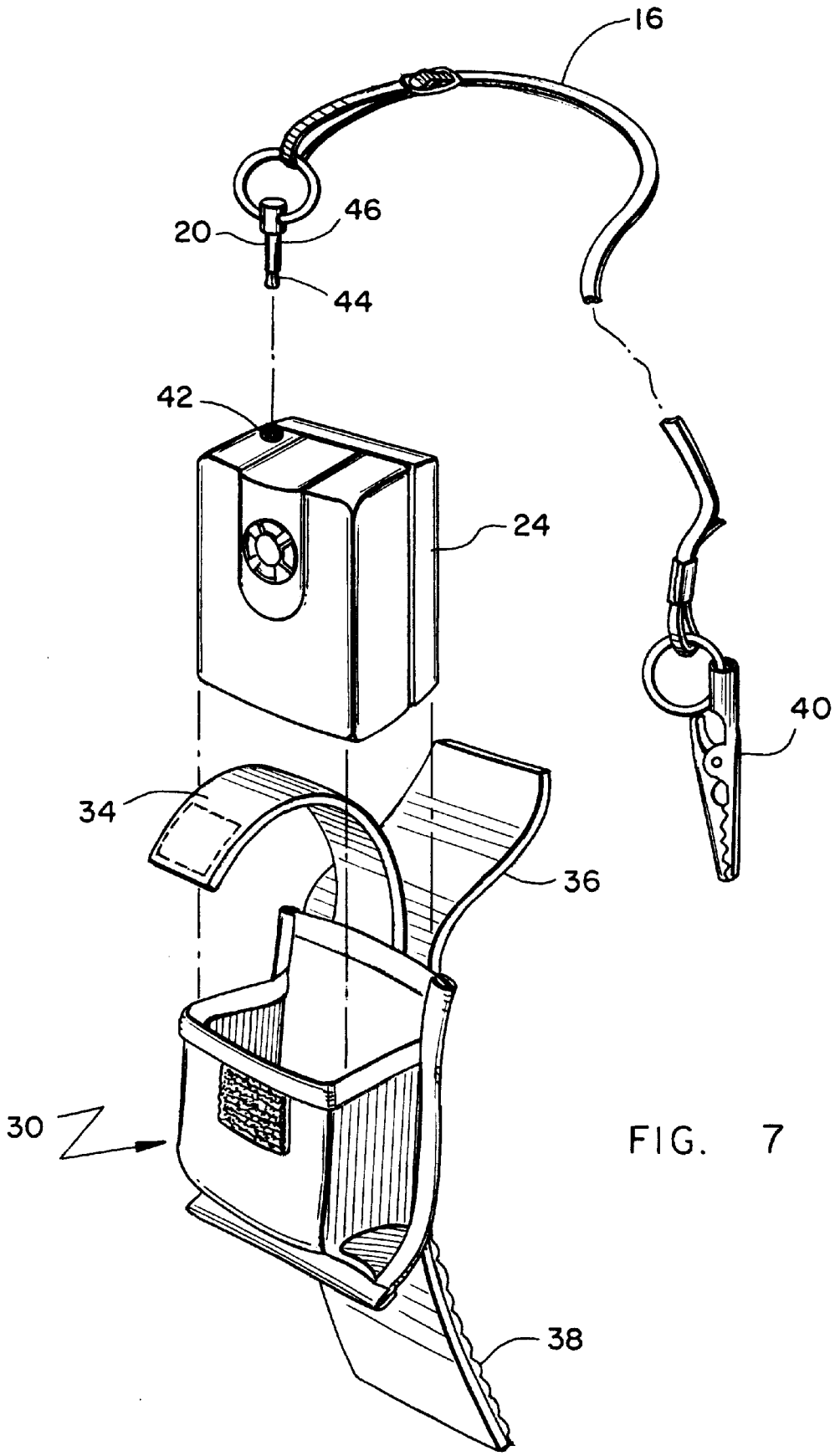
FIG. 7 is a perspective view of the device of the invention illustrating the various components that comprise the device.

Referring now to FIGS. 5, 6 and 7, FIG. 5 shows the alarm component that includes an alarm device 24 of any suitable well-known type that is battery operated and which will cause a loud audible alarm to be actuated when an alarm pin 20 is removed from the alarm device 24. The actuator cord 16 is connected to the alarm pin 20 in any suitable manner such as by ring 26. In order to attach the alarm device 24 to a bed, wheelchair, etc., FIG. 5 illustrates a tubular member 28 which could be the rail of a bed or wheelchair. The alarm component is contained in a suitable case 30 having a pocket 32 to receive the alarm device 24 and a strap 34 that passes over the alarm device 24 to retain it in the pocket 32. The strap 34 may be connected to the pocket 32 in any suitable manner such as by snap, Velcro fastener, etc.

In order to connect the case 30 containing the alarm device 24 to the rail 28, a strap 36 is appropriately attached to the case 30 in any suitable manner such as by an adhesive or by sewing. Preferably, the strap 36 is such that it can be adjusted to fit rails 28 of varying sizes and shapes. A strap 36 having a Velcro fastener is preferred.

As best seen in FIG. 6, the surface of the strap 36 that is to be connected to the rail 28 contains a textured surface 38 that is of a high friction material. Such material might be a rubberized fabric or material so that the case 30 will not slip around the rail. This is a necessary feature so that if the alarm pin 20 is pulled, the alarm device 24 will be retained in the case 30 without the case 30 twisting around a circular shaped rail 28.

Referring now to FIG. 7, the entire device of the invention is shown in perspective and in an exploded view. The distal end of the actuator cord 16 contains a suitable clip 40 such as an alligator clip that can be easily attached securely to the clothing of the individual. The alarm pin 20 is designed so that it is does not easily fall out of the alarm device 24. In other words, there must be a friction or interference fit between the alarm pin 20 and the receptacle 42 in the alarm device 24. For example, the pin may have a head 44 that is enlarged and tapered toward the main shaft 46 of the pin. In any event, the pin must resist some force but the force required to remove the pin from the alarm device and thus actuate the alarm must be less than the force required to pull the alligator clip 40 from the clothing of the individual. In other words, the alarm pin 20 must be pulled from the alarm device 24 to actuate the alarm any time that the individual to whom the device is attached by the clip 40 moves beyond the range determined by the length of the actuator cord 16.

The operation and use of the device should be evident from the foregoing description. However, in summary, the device is used as follows. The alarm device 24 is placed in the pocket 32 of the case 30, and the strap 34 is fastened over the top of the alarm device 24 to hold it securely in place in the pocket 32. With the alarm pin 20 in place in the receptacle 42 of the alarm device 24 so that the alarm is not actuated, the case 32 is then secured to the rail 28 by wrapping the strap 36 around the rail and securing it tightly in place. Once the individual to be guarded is in place in the wheelchair 22 or bed 10, the clip 40 is used to fasten the actuator cord to the clothing of the individual. The length of the actuator cord 16 is determined by the amount of freedom that the individual is to be permitted before the alarm is actuated. Obviously, if an individual is lying in bed, the actuator cord 16 should allow the individual a certain amount of movement. A more elaborate or expensive version of the invention may include a different power source a means for message transmittal to a response center or medical facility.

From the foregoing description, it is evident that the invention provides an easy to use, almost foolproof but yet inexpensive alarm device to protect individuals who are to be protected if they move or fall from a particular position. The device is simple, easy to use and effective.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A personal alarm device comprising:

an alarm base having a receptacle, a releasable trigger combined with the base and removably received in the receptacle so that removal of the trigger from the receptacle activates the alarm, the trigger having an enlarged head that provides an interference fit with the receptacle so as to provide a resistance force to removal of the trigger, a strap having a first end and a second end, said first end combined with the trigger and said second end combined with a connector that may be attached, directly or indirectly, to a patient; and said trigger being removable from the receptacle to activate the alarm upon application of a trigger release force that is less than a connector release force required to release the connector from the patient.

2. The personal alarm device of claim 1 wherein:

the alarm base further comprises a power source and a signal generator.

3. The personal alarm device of claim 1 further comprising:

an alarm base case having a strap with a high friction surface engageable with a mounting surface for securing the case to the mounting surface so that a force necessary to move the high friction surface relative to the mounting surface is greater than the connector release force required to release the connector from the patient and greater than the trigger release force required to remove the trigger from the receptacle in the base.

4. The personal alarm device of claim 3 wherein the base case further comprises a sidewall defining an opening therein and a retainer combined with the side wall to at least partially cover the opening formed therein.

5. An alarm unit case for use in securing to a mounting surface that has curved outer wall an alarm unit requiring force to activate the unit, said case comprising:

a pocket having sidewalls that define an opening in the pocket for receiving and containing the alarm unit case in the pocket;

a retainer combined with a side wall to at least partially cover the opening so as to removably retain the alarm unit in the pocket;

a flexible case mounting strap combined with a sidewall for securing the case to the mounting surface, the case mounting strap having a first side comprised of a high friction surface, said high friction surface being adapted to contact the mounting surface outer wall when the case mounting strap is wrapped generally about the mounting surface shaft; and a case mounting strap fastener combined with the case mounting strap and being adapted to maintain the high friction surface in contacting relationship with the mounting surface outer wall so that a force necessary to move the high friction surface relative to the mounting surface is greater than the force required to activate the alarm unit.

* * * * *